US006017589A

United States Patent [19]

Kuriyama

[11] Patent Number: 6,017,589

[45] Date of Patent: Jan. 25, 2000

[54] PROCESS FOR FORMATION OF COATING FILM

[75] Inventor: Yoshitaka Kuriyama, Hiratsuka, Japan

[73] Assignee: Kansai Paint Co., Ltd., Hyogo-ken, Japan

[21] Appl. No.: 09/167,871

[22] Filed: Oct. 7, 1998

[51] Int. Cl.[7] ..... B05D 1/38

[52] U.S. Cl. ..... 427/407.1; 427/409; 428/457

[58] Field of Search ..... 427/407.1, 409; 428/457

[56] References Cited

FOREIGN PATENT DOCUMENTS 1-215380 8/1989 Japan .
7-316458 12/1995 Japan .
8-155384 6/1996 Japan .

*Primary Examiner*—Erma Cameron
*Attorney, Agent, or Firm*—Huntley & Associates

[57] ABSTRACT

A process for forming a coating film, the process comprising the steps of coating a substrate with a dark color coating comprising a thermosetting resin composition, a coloring pigment, carbon black pigment and a light-iridescent pigment, and coating the dark color coat with a color clear coating comprising a thermosetting resin composition and carbon pigment. The process permits forming a coating film having superior aesthetic appearance, wherein the coating film exhibits an excellent light-iridescent, or pearl-like, appearance at the highlight portion and a dark color appearance having an excellent pitch-black feeling without muddiness in the shade portion.

3 Claims, No Drawings

PROCESS FOR FORMATION OF COATING FILM

BACKGROUND OF THE INVENTION

1. Field of the Invention

The present invention relates to a process for forming coatings having superior aesthetic appearance. Specifically, the coatings of the present invention exhibit an excellent iridescent, or pearl-like, appearance at the highlight portion and a dark color having an excellent pitch-black appearance without muddiness in the shade portion.

2. Description of the Prior Art

It is already known to apply a dark color coating comprising a thermosetting resin composition, a coloring pigment, a light-iridescent pigment and carbon black pigment, and apply onto the dark color coat a colorless and transparent clear coating which contains no coloring pigment. Such coating methods are widely used to apply a top coat for automotive exterior panels. The coating film formed by this technique, however, is not entirely satisfactory in its aesthetic appearance. Although it exhibits an excellent light-iridescent, or pearl-like, appearance at the highlight portion, the coating film exhibits a cloudy dark color in the shade portion.

SUMMARY OF THE INVENTION

The present invention eliminates the above-mentioned drawbacks in the coating film of the prior art. The present invention provides a novel process for forming a coating film superior in aesthetic appearance. Specifically, the coating films of the present invention exhibit an excellent light-iridescent or pearl-like appearance at the highlight portion and a dark color appearance without muddiness in the shade portion.

The advantages of the present invention are realized by using a combination of a thermosetting resin composition, carbon black pigment and, as necessary, a coloring pigment in the color clear coating. The resulting coating film is superior in aesthetic effect. Specifically, the coating film exhibits an excellent light-iridescent, or pearl-like appearance at the highlight portion and a dark color having an excellent pitch-black feeling without muddiness in the shade portion.

Specifically, the present invention provides a process for forming a coating film, the process comprising the steps of coating a substrate with a dark color coating comprising a thermosetting resin composition, a coloring pigment, a light-iridescent pigment, and coating the dark color coat with a color clear coating comprising a thermosetting resin composition and carbon pigment.

DETAILED DESCRIPTION OF THE INVENTION

The present invention will be more fully understood by reference to the following description and examples.

Dark color coating

The dark color coating used in the present invention can be a liquid composition comprising at least one thermosetting resin composition, at least one coloring pigment, at least one carbon black pigment and at least one light-iridescent pigment. The dark color coating can be prepared by dispersing the above-mentioned components in an organic solvent.

The coloring pigment is a coloring pigment other than a light-iridescent pigment and carbon black pigment.

Examples of coloring pigments which can be used in the present invention are inorganic or organic solid-color pigments such as titanium oxide, zinc oxide, Cadmium Red, Molybdenum Red, Chrome Yellow, chrome oxide, Prussian Blue, Cobalt Blue, azo pigments, phthalocyanine pigments, quinacridone pigments, isoindoline pigments, threne derivative pigments, perylerne derivative pigments and the like. These coloring pigments can be used singly or in combination, but it is preferable to choose and combine these pigments so that the tone of the resulting coating film is a dark color.

Examples of light-iridescent pigments which can be used in the present invention include mica, mica coated with a metal oxide such as titanium oxide, iron oxide or the like, graphite coated with titanium oxide, or the like. These light-iridescent pigments can be used singly or in combination.

Examples of carbon black pigments which can be used in the present invention include channel black, thermal black, furnace black and the like.

The thermosetting resin composition is preferably a composition comprising a base resin such as acrylic resin, vinylic resin, polyester resin, alkyd resin, urethane resin or the like, having a crosslinkable functional group such as hydroxyl group, epoxy group, carboxyl group, alkoxysilyl group or the like and a crosslinking agent such as alkyl etherified melamine resin, urea resin, guanamine resin, blocked or unblocked polyisocyanate compound, carboxyl group-containing compound or the like. The proportion of the base resin is generally about from 50 to 90% by weight and the proportion of the crosslinking agent is, complementally, about from 50 to 10% by weight, based on the total solid content of the two components.

In the dark color coating, the amounts of the above-mentioned components can vary widely. Generally, the coloring pigment is present in an amount of about from 0.1 to 10 parts by weight, particularly 0.1 to 1.0 part by weight; the light-iridescent pigment is generally present in an amount of about from 1 to 20 parts by weight, particularly 8 to 10 parts by weight; and carbon black pigment is generally present in an amount of about from 0.1 to 4 parts by weight, particularly 1.0 to 3.0 parts by weight; all per 100 parts by weight of the total solid content of the thermosetting resin composition in the dark color coating.

It is preferable to adjust the dark color coating composition to an application viscosity of 12 to 15 seconds (Ford cup #4/20° C.) and an application solid content of 20 to 40% by weight of the dark color coating.

The preferable color tone of the separate film of the dark color coating is 1 to 4, particularly 1 to 2, in terms of N value, and 0 to 40, particularly 0 to 10, in terms of L value in Munsell's color system. The preferable hiding power of the dark color coating is 10 to 15 micrometers.

In the process for forming a coating film according to the present invention, the dark color coating can be coated directly on a metallic or plastic substrate such as an automobile body or the like. It is generally preferred, however, that the substrate is pre-coated with a primer such as cationic electrocoating and/or an intermediate coating, and then cured.

The dark color coating can be applied by air spraying, airless spraying, electrostatic coating or the like in a film thickness of generally about from 5 to 30 micrometers, particularly about from 10 to 20 micrometers as cured.

In the present invention, after the film of the dark color coating is dried at room temperature or at an elevated temperature (100° C. or less is preferable) without crossliiking and curing, or after the film of the dark color coating is heated to cure at a temperature of about 120 to about 160° C. for about from 10 to 40 minutes, then a color clear coating is applied thereon.

Color clear coating

The color clear coating used in the process of the present invention is a coating which is applied on the uncrosslinked or crosslinked film of the dark color coating and is a liquid coating composition which comprises at least one thermosetting resin composition, at least one carbon black pigment, and, as necessary, at least one coloring pigment. This color clear coating contains substantially no light-iridescent pigment.

The color clear coating can be prepared by dispersing the above-mentioned components in an organic solvent.

Examples of thermosetting resin compositions, carbon black pigments and coloring pigments which can be used in the color clear coating are as same as those mentioned in the dark color coating. These components can be used singly or in combination.

In the color clear coating, the amounts of the above-mentioned components, can vary widely. In general, about from 0.01 to 5 parts by weight, particularly about from 0.03 to 0.1 parts by weight, of the carbon black pigment is used; and up to about 5 parts by weight, particularly about from 0.01 to 0.05 parts by weight of the thermosetting resin composition is used in the color clear coating, each per 100 parts by weight of the total solid content.

It is preferable to adjust to an application viscosity of the color clear coating to about from 20 to 30 seconds (Ford cup #4/20° C.) and an application solid content of about form 40 to 60% by weight of the color clear coating.

The separate film of the color clear coating is semi-transparent and the light transmittance is generally at least about 20%, and preferably at least about 50%, in a film thickness of 50 micrometers as cured. The color tone of the color clear coating is about 2 or less in terms of N value and about 5 or less in terms of L value in Munsell's color system when this color clear coat is applied on a black substrate so as to give a film 50 micrometers in thickness as cured.

In the present invention, the color clear coating is applied on the uncrosslinked or crosslinked film of the dark color coating by air spraying, airless spraying, electrostatic coating or the like in a film thickness of generally about from 20 to 80 micrometers, particularly about from 40 to 60 micrometers as cured. The resulting film can be allowed, as necessary, to stand at room temperature to 100° C. for several minutes and then heated at a temperature of about from 120 to 160° C. for about from 10 to 40 minutes to subject the two-layered film of the dark color coating and the color clear coating to curing.

The process for forming a coating film according to the present invention, comprising the steps of coating a substrate with a dark color coating comprising a thermosetting resin composition, a coloring pigment, and a light-iridescent pigment, and coating the dark color coat with a color clear coating comprising a thermosetting resin composition and carbon pigment, can form a coating film superior in aesthetic appearance. Specifically, the resulting coating film exhibits an excellent light-iridescent or pearl-like appearance at the highlight portion and a dark color having an excellent pitch-black feeling without muddiness in the shade portion.

While these results of the present invention are not fully understood, it is believed that, as the color clear coating is semi-transparent, the coating film exhibits an excellent light-iridescent appearance (pitch-like feeling) at the highlight portion because the light passes through the color clear coating and reflects at the light-iridescent coloring material of the dark color coating at the highlight portion. In the shade portion, the coating film is believed to scatter the light a little without showing a light-iridescent appearance because the light-iridescent coloring material orients parallel to the surface of the dark color coating. When a colorless and transparent clear coating which contains no coloring pigment is used as a top coat, this light scattering is recognized as cloudiness and therefore the resulting coating film exhibits a poor aesthetic appearance, having a cloudy dark color appearance in the shade portion. On the other hand, when a semi-transparent color clear coating according to the present invention is used, the scattered light is absorbed in the color clear coating and therefore the resulting coating film exhibits a dark color appearance having an excellent pitch-black feeling without muddiness in the shade portion because the light-path length in the semi-transparent film is longer than that in the transparent film.

The present invention is described more fully in the following Examples and Comparative Example.

EXAMPLES 1 AND 2 AND COMPARATIVE EXAMPLE A (1) Substrate Preparation

A degreasecd and zinc phosphate-treated steel plate was electrocoated with an epoxy resin polyamine-blocked polyisocyanate compound, commercially available from Kansai Paint Co., Ltd., ad "ELECRON #9400." The plate was electrocoated by cationic electrocoating so as to deposit a film of 20 micrometers in thickness as cured. The cationic electrocoated film was heated at 170° C. for 20 minutes for curing. An intermediate coating was then applied on the cured electrocoated film. The intermediate coating was a polyester resin-melamine-type resin commercially available from Kansai Paint Co., Ltd. as "RUGABA.KE INTERMEDIATE." The resin was applied in an organic solvent so as to give a film 40 micrometers in thickness as cured. The film obtained from the Intermediate coating was heated at 1400° C. for 30 minutes for curing.

(2) Dark color coating (A)

(A-1):

An organic solvent type coating composition obtained by mixing 70 parts (solid) by weight of a hydroxyl group-containing polyester resin having a hydroxyl value of 100 mgKOH/g, an acid value of 8 mgKOH/g, a number-average molecular weight of 3,000, 30 parts (solid) by weight of butylated melamine resin, 0.3 part by weight of a phthalocyanine pigment (commercially available as "PHTHALOCYANINE BLUE G314" from Sanyo Pigment Co., Ltd.), 3.0 parts by weight of a light iridescent blue mica (commercially available as "IRIOGINE 225" from Merck Co., Ltd.), 2.7 parts by weight of a carbon black pigment (commercially available as "MONAQUE 1400" from Cabott Co., Ltd.,) and a mixture of toluene and xylerie (50/50 by weight ratio), followed by adjusting to a viscosity of 13 seconds (Ford cup #4/20° C.) and a solid content of 28% by weight. The color tone of the separate film of the dark color coating (A-1) is 2 in terms of N value and 7 in terms of L value in Munsell's color system. The hiding power of the dark color coating (A-1) is 15 micrometers.

(A-2):

An organic solvent type coating composition was obtained by mixing 70 parts (solid) by weight of a hydroxyl group-containing polyester resin having a hydroxyl value of 100 mgKOH/g, an acid value of 8 mgKOH/q, and a number-average molecular weight of 3,000; 30 parts (solid) by weight of butylated melamine resin; 0.3 part by weight of a phthalocyanine pigment (available from Sanyo Pigment Co., Ltd. as "PHTHALOCYANINE BLUE G314'); 3.0 parts by weight of a light-iridescent green mica (available from Merck Co., Ltd., as 'IRIOGINE 235'); 2.7 parts by weight of carbon black pigment (available from Cabott Co., Ltd. as "MONAQUE 1400'); and a mixture of toluene and xylene (50/50 by weight ratio), followed by adjusting to a viscosity of 13 seconds (Ford cup #4/20° C.) and a solid content of 29% by weight. The color tone of the separate film of the dark color coating (A-1) is 2 in terms of N value and 5 in terms of L value in Munsell's color system. The hiding power of the dark color coating (A-1) is 14 micrometers.

(3) Color clear coating (B)

(B-1):

An organic solvent type coating composition was obtained by mixing 70 parts (solid) by weight of a hydroxyl group-containing acrylic resin having a hydroxyl value of 80 mgKOH/g, an acid value of 20 mgKOH/g, and a number-average molecular weight of 10,000; 30 parts (solid) by weight of methylated/butylated melamine resin; 0.05 part by weight of the "MONAQUE 1400" carbon black pigment noted above, 0.02 part by weight of a cobalt phthalocyanine pigment (available from Dainichi Seika Co., Ltd.as CHROMOFINE BLUE 500OP"), and a mixture of toluene and xylene (50/50 by weight ratio), followed by adjusting to a viscosity of 23 seconds (Ford cup #4/20° C.) and a solid content of 50% by weight. The color tone of the separate film of the color clear coating (B-1) is 1 in terms of N value and 3.5 in terms of L value in Munsell's color system when this color clear coat is applied on a black substrate so as to give a film 50 micrometers in thickness as cured. The light transmittance of the color clear coating (B-1) is 65% when this color clear coat is applied so as to give a film 50 micrometers in thickness as cured.

(4) Clear coating (B-2) (for comparison):

An organic solvent type coating composition was obtained by mixing 70 parts (solid) by weight of a hydroxyl group-containing acrylic resin having a hydroxyl value of 80 mgKOH/g, an acid value of 20 mgKOH/g, and a number-average molecular weight of 10,000, 30 parts (solid) by weight of methylated/butylated melamine resin, and a mixture of toluene and xylene (50/50 by weight ratio), followed by adjusting to a viscosity of 23 seconds (Ford cup #4/20° C.) and a solid content of 53% by weight. The separate film of this clear coating (B-2) is colorless and transparent.

2. EXAMPLES AND COMPARATIVE EXAMPLES

On the above-mentioned substrate the dark color coating (A) was applied by air spraying. The resulting plate was allowed to stand at room temperature for 5 minutes. Then, on the uncured film of the dark color coating (A), the color clear coating (B-1) or the clear coating (B-2) was applied by air spraying. The resulting plate was allowed to stand at room temperature for 5 minutes and then heated at 140° C. for 30 minutes to subject the two-layered film of the dark color coating (A) and the color clear coating (B) to simultaneous curing. The films were tested for performances and the results are shown in Table 1. The performance of each resulting film was measured as follows.

60 Degree gloss: Determined as a 60 degree specular reflection factor (%).

20 Degree gloss: Determined as a 20 degree specular reflection factor (%).

Color tone at highlight: Determined as color measurement values at 15 degree offset angle from the direct reflectance of 45 degree incident light using "MA 68" (product of X-RITE Co., Ltd.).

Color tone in shade: Determined as color measurement values at 45 degree offset angle from the direct reflectance of 45 degree incident light using "MA 68" (product of X-RITE Co., Ltd.).

As shown in the results reported in Table 1, the coating film of the present invention exhibits an excellent light-iridescent, or pearl-like, appearance at the highlight portion and a dark color appearance having an excellent pitch-black feeling without muddiness in the shade portion because the L values in the shade portion of the Examples are almost one-third of that of the Comparative Example.

TABLE 1

| | | Examples | | Comparative Example |
|---|---|---|---|---|
| | | 1 | 2 | A |
| Dark color coating | Symbol | A-1 | A-2 | A-1 |
| | Film thickness (μm as cured) | 15 | | |
| Color clear coating | Symbol | B-1 | B-1 | — |
| | Film thickness (μm as cured) | 50 | | — |
| Clear coating | Symbol | — | | B-2 |
| | Film thickness (μm as cured) | — | | 50 |
| Performance test results | | | | |
| 60 Degree gloss | | 94 | 95 | 94 |
| 20 Degree gloss | | 90 | 89 | 90 |
| Color tone at highlight | L* | 8.1 | 11.7 | 12 |
| | C* | 16.2 | 15.9 | 21.2 |
| | h* | 263 | 149 | 267 |
| Color tone in shade | L* | 1.2 | 1.4 | 3.5 |
| | C* | 0.7 | 0.8 | 2.8 |

I claim:

1. A process for forming a coating film, the process comprising the steps of (a) coating a substrate with a dark color coating comprising a thermosetting resin composition, a coloring pigment, carbon black pigment, and a light-iridescent pigment, and (b) coating the dark color coat with a color clear coating comprising a thermosetting resin composition and carbon pigment.

2. A process of claim 1 wherein the color clear coating further comprises a coloring pigment.

3. A coated substrate resulting from the process of claim 1.

* * * * *